US006424244B1

(12) United States Patent
Hendel

(10) Patent No.: US 6,424,244 B1
(45) Date of Patent: Jul. 23, 2002

(54) MAGNETIC SWITCH

(75) Inventor: Horst Hendel, Berlin (DE)

(73) Assignee: Tyco Electronics Amp, GmbH, Bensheim (DE)

( * ) Notice: Subject to any disclaimer, the term of this patent is extended or adjusted under 35 U.S.C. 154(b) by 0 days.

(21) Appl. No.: 09/805,289

(22) Filed: Mar. 13, 2001

(51) Int. Cl.[7] ..... H01H 9/00

(52) U.S. Cl. ..... 335/177; 335/78; 335/80; 335/83; 335/84; 335/179; 335/186; 335/190; 335/227; 335/234; 335/279; 335/281

(58) Field of Search ..... 335/78–86, 177–183, 335/185–192, 203, 227, 229–234, 270, 279, 281

(56) References Cited

U.S. PATENT DOCUMENTS 4,810,985 A * 3/1989 Mesenich ..... 335/261

FOREIGN PATENT DOCUMENTS

EP 0442311 A2 1/1991 ..... H01H/71/32

* cited by examiner

*Primary Examiner*—Ramon M. Barrera

(57) ABSTRACT

The invention relates to a magnetic switch having a yoke which has the shape of a rotationally symmetrical cup on the base of which is arranged a permanent magnet. The flux of the permanent magnet is conducted via a core, which has a radial core flange, to the plate-shaped armature. For the operational air gap effective between the armature and the core and the yoke and the magnetic resistance $W_A$ thereof, the following relation applies in relation to the marginal air gap formed between the core flange and the yoke: $W_A<W_R$. As a result of the rotational symmetry with a yoke having the shape of a cup, it is possible to generate a high holding force for the armature with a small structural volume.

16 Claims, 4 Drawing Sheets

MAGNETIC SWITCH

BACKGROUND OF THE INVENTION

The invention relates to a magnetic switch having a cup-shaped yoke, a core, a coil, an armature and a fixed contact and a movable contact.

DESCRIPTION OF THE PRIOR ART

Magnetic switches of this kind are known, for example, from EP 0 442 311 A2, which discloses a magnetic switch in which a non-magnetic armature is moved by a permanent magnet fixedly connected thereto. During this, in the direction of movement of the armature, only an operational air gap between the permanent magnet and the core brings about the effect. Furthermore, the known magnetic switch has a small coupling surface between the permanent magnet and the core, which extends only over the inner region of the cup-shaped yoke.

The known magnetic switch has the disadvantage that the coupling surface between the permanent magnet and the core, and thus the holding force of the magnet system, is only very small relative to the structural volume of the magnetic switch. This means that the known magnetic switch is not suitable for use as a battery disconnecting switch in a motor vehicle, where on the one hand large currents of a few thousand amps have to be switched, and where on the other hand vibrations and jolts act on the magnetic switch. To achieve a greater holding force, it would be possible for special magnetic materials which generate a very strong magnetic field to be used. These have the disadvantage that they are expensive to procure and complicated to process.

SUMMARY OF THE INVENTION

The object of the present invention is therefore to provide a magnetic switch which presses the movable contact onto the fixed contact with a high holding force while having a small structural volume.

This object is achieved by a magnetic switch having a yoke that has the shape of a cup with an axis of symmetry. The cup has a base and a wall and is open to one side. Arranged in the cup is a core which has a radial core flange at its end facing the base. This radial core flange forms with the wall of the cup a marginal air gap with a width of $H_R$. This marginal air gap has a magnetic resistance of $W_R$. Furthermore, the cup contains a plate-shaped permanent magnet which is magnetised parallel to the axis of symmetry of the cup. The permanent magnet is arranged between the core flange and the base and is magnetically coupled thereto. Moreover, arranged in the cup is a coil whereof the coil axis is the axis of symmetry of the cup. The cup is covered by a plate-shaped armature which forms with the yoke a yoke air gap with a width of $H_J$ and forms with the air gaps together form, connected serially one behind the other, the operational air gap, which has a magnetic resistance of $W_A$. Moreover, there is arranged on the magnetic switch a means for lifting the armature axially away from the cup. In the closed condition of the magnetic switch, the following applies: $W_A<W_R$.

As a result of the construction of the magnetic switch, in accordance with the invention, a magnetic switch is produced which is shielded from the outside extremely well and has only extremely low scattering losses for the magnetic fields. Because the armature forms an operational air gap with the core and the cup-shaped yoke, a coupling surface which is as large as possible is formed with a particular predetermined structural volume. The large coupling surface between the armature and the yoke and the core respectively results in a large holding force of the magnetic switch in the closed condition. Because the magnetic resistance of the operational air gap is smaller than the magnetic resistance of the marginal air gap, it is ensured that the majority of the magnetic flux of the permanent magnet is conducted through the armature in the closed condition. The system polarised by the permanent magnet moreover has the advantage that only a short switch pulse has to be sent through the coil in order to close the switch, and the coil current can be returned to zero in the closed condition. This means, in particular, that low-power operation of the magnetic switch is possible.

In order to achieve the maximum holding force of the armature, it would be desirable for the ratio $W_R/W_A$ to be as large as possible. This would ensure that all of the magnetic flux of the permanent magnet is guided through the armature without losses being produced by way of the marginal air gap. A very large ratio $W_R/W_A$ would, however, mean that a high counter-excitation of the coil would be required to open the switch, in order to displace the magnetic field of the permanent magnet out of the core and guide it through the marginal air gap and the wall of the cup, back onto the underside of the permanent magnet. Consequently, for the magnetic switch to have a high sensitivity to switching off, it would be desirable for the ratio $W_R/W_A$ to be in the order of magnitude of one. Thus, it is particularly advantageous to set the ratio $W_R/W_A$ such that both the holding force of the armature and the sensitivity of the magnetic switch to switching off are in a reasonable range. Tests have shown that this is the case if the ratio $W_R/W_A$ is selected to be between 1 and 100. A ratio $W_R/W_A=50$ has been shown to be particularly advantageous.

A magnetic switch according to the invention may for example readily be produced with the following dimensions: for the cup, a radial extent of between 10 mm and 50 mm is chosen. With a size such as this, a compact construction is possible for the magnetic switch, as is specifically necessary for its use as a battery disconnecting switch in a motor vehicle. For the width of the yoke and core air gaps, purely for reasons of the superficial roughness of the underside of the armature or of the surfaces of the cup wall and the core, the following range can readily be set: 0.005 mm$<H_J<$0.05 mm and 0.005 mm$<H_K<$0.05 mm. If a wall thickness of the cup of approximately 1 mm is chosen, moreover, then a surface for the yoke air gap with a size of approximately 100 $mm^2$ is obtained. If the core air gap or the marginal air gap is constructed to have approximately the same order of magnitude as regards their surfaces, then to fulfil the relation mentioned above between the magnetic resistances of the operational and the marginal air gaps, the following apply: 1 mm$>H_R>$0.1 mm. The said dimensions of the core and yoke air gaps relate to the closed condition of the switch. With a magnetic switch constructed in accordance with these example dimensions, a holding force of approximately 30 N can be achieved. The axial extent of the switch corresponds approximately to the radial extent. A magnetic switch of this type can be switched at a switching capacity of approximately 0.7 W.

Particularly advantageous is a magnetic switch in which the yoke, permanent magnet, core, coil and armature are arranged rotationally symmetrically about the axis of symmetry. As a result of the rotationally symmetrical arrangement according to the invention of the elements of the magnetic switch about the axis of symmetry, an optimum flux concentration is achieved in the interior of the switch without magnetic field losses occurring at corners or edges. Moreover, a magnetic switch with rotational symmetry is easy to produce.

Furthermore, particularly advantageous is a magnetic switch in which the permanent magnet is of a material containing barium ferrite. Barium ferrite is a readily available, inexpensive material for a permanent magnet, which greatly simplifies production of the magnetic switch. Because of the high holding force of the magnetic switch according to the invention, expensive highly magnetised special materials for the permanent magnet can be dispensed with.

Furthermore, particularly advantageous is a magnetic switch in which the yoke and/or the core are of a material which contains magnetically soft iron. Magnetically soft iron can very readily be demagnetised, which simplifies the displacement of the flux of the permanent magnet out of the core when the magnetic switch is opened. Furthermore, magnetically soft iron has a low magnetic resistance, as a result of which it is ideal for conducting the flux of the permanent magnet to the armature.

A high holding force of the magnetic switch may be achieved in particular in that the core and the yoke are dimensioned, at least in the region of the corresponding air gaps, in cross-section such that in the closed condition and in the absence of excitation, that is to say when the coil current is 0, there is almost magnetic saturation.

Furthermore, it is particularly advantageous for the armature to be constructed in accordance with the invention with a radially varying plate thickness such that there is almost magnetic saturation in the entire armature in the closed condition of the magnetic switch. For this, it is in particular possible to make the armature thinner at the edge than in the centre, since the cross-sectional surface available for the magnetic flux increases with the distance from the axis of symmetry. The thickness of the armature can be lessened accordingly with increasing distance from the axis of symmetry. This makes it possible to reduce the mass of the armature to the absolutely minimum amount required. A minimised armature mass of this kind has the advantage that the magnetic switch is less sensitive to vibrations or shocks, since in this case it is primarily the inert mass of the armature which determines the extent to which the armature can respond to rapid accelerations.

Furthermore, the magnetic switch may be constructed to be particularly compact if, according to the invention, a hole running along the axis of symmetry is provided in the yoke, the permanent magnet, the core and the armature, and through this hole runs a pin. This pin is secured to the armature at one end, and at the other end is coupled to a movable contact which makes contact with a first fixed contact in the closed condition of the magnetic switch. With the aid of the movable contact and the fixed contact, the circuit of a motor vehicle, for example, may be switched.

Moreover, particularly advantageous is a switch in which the movable contact is a flange-shaped contact disc which is arranged symmetrically with respect to the axis of symmetry and has a central hole. In this case, the pin is secured in the hole in the armature by means of flange-shaped end portions and is suspended in the contact disc from a collar projecting into the contact disc hole. The contact disc makes contact with a first and a second fixed contact in the closed condition. Arranged in the hole in the permanent magnet is a pressure spring contact supported against the armature and the contact disc. The end of the pin remote from the armature is pre-tensioned in the direction of the armature via a rocker by means of a tension or pressure spring. The rocker according to the invention, which is coupled to the pin, is a simple means of raising the armature axially away from the cup. The pressure spring contact supported against the armature and the contact disc has the advantage that the holding force of the armature can be transmitted over a certain distance, regardless of the spacing between the fixed contacts and the base of the cup.

Here, it is particularly advantageous to select the length of the pin, in accordance with the invention, such that when the magnetic switch opens, the lower pin flange moves by an overtravel distance Hu before it engages with the contact disc. This overtravel has the advantage that, when the magnetic switch opens, first the armature is greatly accelerated, together with the pin, as a result of the pressure spring contact, and only once the lower pin flange has engaged with the collar are the contacts pulled open by the forces of inertia thereby gained. The overtravel distance is preferably set in a range of between 0.5 mm and 1 mm.

Furthermore, particularly advantageous is a magnetic switch in which the pin is suspended in a spring contact secured to the second fixed contact and bearing the movable contact. The arrangement according to the invention, of a spring contact on the second fixed contact, has the advantage that it is possible to dispense with the pressure spring contact inside the cup. This means that the construction of the spring contact is no longer determined by the dimensions of the cup, but that it can be shaped and arranged outside the cup in almost any desired way.

For the spring contact, a possible material is for example spring steel or a nickel/iron alloy. Although these materials have a very good spring action, they are not suitable for conducting electrical current from the second fixed contact to the movable contact, because of their poor conductivity. Furthermore, it is particularly advantageous for the movable contact to be electrically connected to the second fixed contact by means of a litz wire. This litz wire may for example be of copper, which conducts electrical current very well.

So that the magnetic switch can be operated even if the circuit fails, it is particularly advantageous to arrange on the rocker an actuating element which can be used to open the switch manually. This actuating element moreover has the advantage that it can be arranged such that its position can be visually recognised on the switch from the outside. This means that the means of manually opening the switch can be used as an indicator of the condition of the switch at the same time.

DETAILED DESCRIPTION OF THE PREFERRED EMBODIMENT

Figure 1:
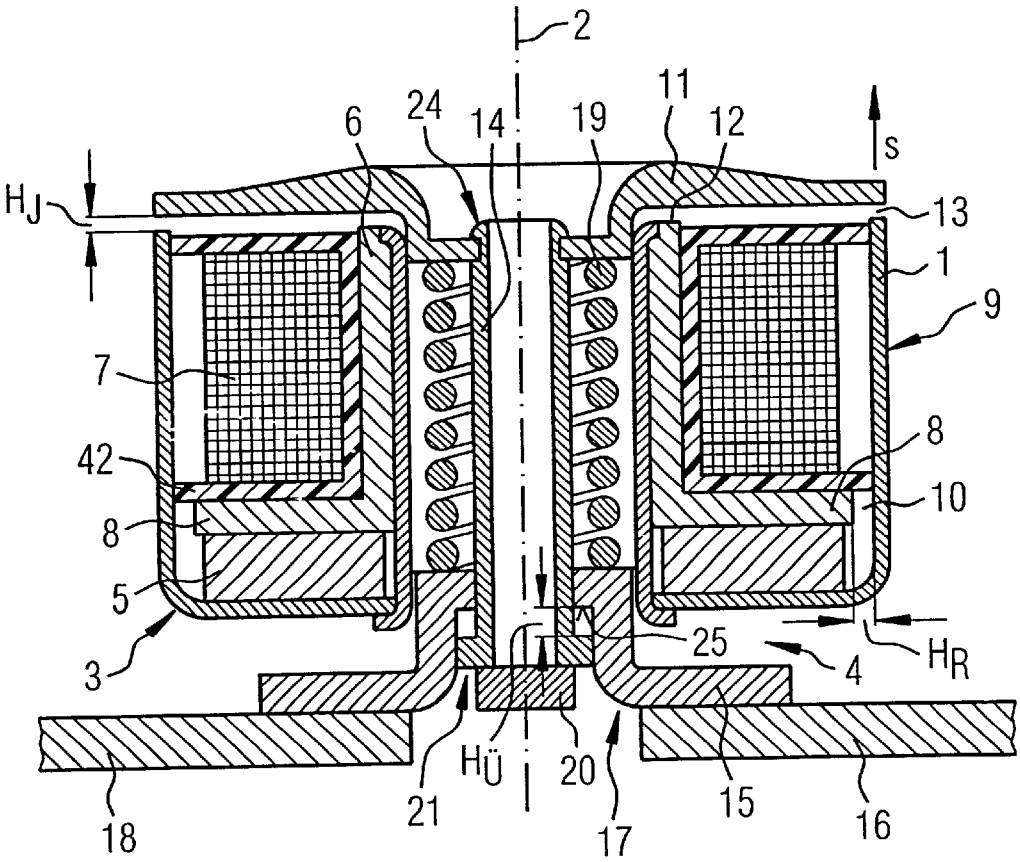
FIG. 1 shows a first embodiment of the magnetic switch according to the invention, in diagrammatic cross-section.

FIG. 1 shows a magnetic switch which is constructed to be substantially rotationally symmetrical with respect to the axis of symmetry 2 that has a yoke 1 in the shape of a cup 3. The cup 3 has a base 4 and a wall 9. It is made of a magnetically soft material such as iron. A permanent magnet 5 is laid on the base 4. The permanent magnet 5 is made for example of barium ferrite. It is magnetised parallel to the axis of symmetry 2. As a result of the permanent magnet 5 coming into contact with the base 4, a magnetic coupling is produced between these two bodies.

A core 6 having a core flange 8 is arranged on the permanent magnet 5. The core 6 is made of a magnetically soft material such as iron. The core flange 8 comes into contact with the permanent magnet 5 so that there is a magnetic coupling between these two bodies. A coil 7 which is wound onto a coil bobbin 42 is arranged on the core 6. The cup 3 is covered by a plate-shaped armature 11.

The armature 11 may be made from a magnetically soft material such as iron. In the closed condition of the magnetic switch, the armature 11 is placed on the cup 3, with a core air gap 12 being formed between the core 6 and the armature 11 and a yoke air gap 13 being formed between the yoke 1 and the armature 11.

The core air gap 12 and the yoke air gap 13 may for example result simply from the superficial roughness of the armature 11 and the yoke 1 or the core 6. It may, however, also result from a protective coating on the surface of the armature 11, which is applied at a defined thickness for example by vapour deposition, sputtering or galvanic deposition, and which may be for example of copper or nickel. With the aid of a protective coating of this kind, the width $H_K$ of the core air gap 12 can be matched precisely to the width $H_R$ Of the marginal air gap 10.

For the width $H_J$ of the yoke air gap 13 and the width $H_K$ of the core air gap 12, the following applies: 0.005 mm$<H_J<$0.05 mm and 0.005 mm$<H_K<$0.05 mm. Between the core flange 8 and the wall 9 of the yoke 1 there is a further air gap, the marginal air gap 10. The yoke air gap 13 and the core air gap 12 together form, connected serially one behind the other, the operational air gap of the magnetic switch. The operational air gap has a magnetic resistance of $W_A$. The marginal air gap has a magnetic resistance of $W_R$.

In order, as already described above, to set a ratio of $W_R/W_A$ which is suitable for the holding force and sensitivity to switching off of the magnetic switch, with a typical diameter of the magnetic switch of 30 mm and a thickness of the wall 9 of 1 mm, and with a dimension of the core 6 which can be derived from this with a properly scaled drawing, a width $H_R$ for the marginal air gap of between 1 mm and 0.1 mm is chosen. Thus, a holding force for the armature 11 of 30 N can be achieved for a magnetic switch of this type.

The armature 11 is constructed as regards its plate thickness, varying over the radius, such that in the closed condition of the magnetic switch there is as complete as possible magnetic saturation of the armature 11. This means that the thickness of the armature 11 lessens with increasing distance from the axis of symmetry 2. This makes it possible to construct the armature 11 to be preferably low in mass, so that the magnetic switch becomes insensitive to those jolts and vibrations which occur in particular in motor vehicles.

The opened condition of the switch is achieved by raising the armature 11 by a spacing s in the direction of the axis of symmetry 2. The armature 11 is coupled to a contact disc 17 by means of a pin 14. The pin 14 has an upper pin flange 24 by means of which it is secured to the armature 11.

The contact disc 17 is in the shape of a flange with an inwardly projecting collar 25. The pin 14 is connected axially movably to the contact disc 17 by means of a lower pin flange 21. The contact disc 17 is a movable contact 15 which bridges a first fixed contact 16 to a second fixed contact 18. The contact disc 17 may be for example of copper.

The fixed contacts 18, 16 are made from electrically conductive material and may for example be injection moulded into a plastics housing. In the interior of the cup 3 there is arranged a pressure spring contact 19 which is supported against the armature 11 and the contact disc 17. Since the lower pin flange 21 is movable within the contact disc 17 by an overtravel distance $H_U$, secure contact between the contact disc 17 and the fixed contacts 16, 18 is ensured even if the contacts 15, 16, 18 are reduced in thickness by contact erosion. The pressure spring contact 19 transmits the holding force of the armature 11 to the contact disc 17. At the lower end of the pin 14, there is arranged a rocker 20 (illustrated only diagrammatically here) which presses the armature 11 upwards into the opened position by spring tension. By applying a coil current across the coil 7, a strong magnetic field is produced which pulls the armature into the closed position.

As already described above, the magnetic resistances of the operational and marginal air gaps $W_A$, $W_R$ are set such that in the closed condition almost the entire magnetic flux of the permanent magnet 5 is conducted through the core 6 into the armature 11. The holding force exerted by the permanent magnet 5 on the armature 11 is sufficiently large that the coil current can be switched off once the closed condition is reached. Thus, low-power operation of the magnetic switch is possible.

In an example embodiment having the dimensions mentioned above, it was possible for the armature 11 to be moved from the opened to the closed condition with a switching capacity of 0.7 watts. Low-power operation of this kind for the magnetic switch is particularly important in cases where electrical power is only available to an extremely limited extent, such as in motor vehicles.

In order to open the magnetic switch, a current opposed to the coil current used to close the magnetic switch is sent through the coil 7. This displaces the magnetic field of the permanent magnet 5 out of the core 6 and thus out of the armature 11. The pressure spring contact 19 tensioned between the armature 11 and the contact disc 17 now raises the armature 11 to such an extent that the lower pin flange 21 engages with the collar 25 of the contact disc 17. As a result of the force of inertia obtained in this first switching component, the contact disc 17 is now raised away from the fixed contacts 16, 18, whereby the current flowing through the fixed contacts 16, 18 is reliably interrupted. Once the contact disc 17 has been raised away from the fixed contacts 16, 18, the armature finally attains the opened position of the magnetic switch, where it is held by the rocker 20 until either the armature 11 is moved manually back into the closed position or else a new switching procedure takes place by means of the coil 7.

Figure 2:
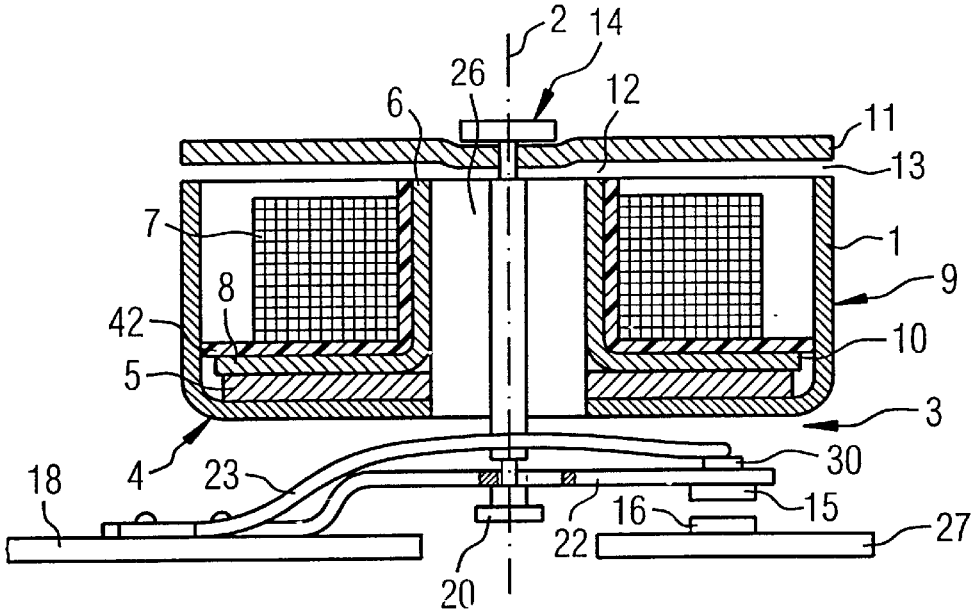
FIG. 2 shows a second embodiment of the magnetic switch according to the invention, in diagrammatic cross-section.

FIG. 2 shows a magnetic switch according to the invention, having a yoke 1, an axis of symmetry 2, a cup 3 with a base 4 and a wall 9, a permanent magnet 5, a core 6 and a coil 7, with the cup 3 being covered by an armature 11. The armature 11 forms with the core 6 a core air gap 12 and with the yoke 1 a yoke air gap 13. As regards the parts mentioned, the magnetic switch is of exactly the same construction as the magnetic switch shown in FIG. 1.

The armature 11 is coupled to the spring contact 22 by means of a pin 14 which runs in a pin sleeve 26 running through the centre of the cup 3. The spring contact 22 bears the movable contact 15. In the closed state of the magnetic switch, the movable contact 15 is electrically connected to a first fixed contact 16 which for its part is secured to a contact beam 27. The spring contact 22 is secured to a second fixed contact. Possible materials for the spring contact 22 are in particular spring steel or a nickel/iron alloy. Since such materials conduct electrical current poorly, the movable contact 15 is brought into contact with a litz wire 23 by means of solder 30. The litz wire 23 is fixedly connected to the second fixed contact 18 and of flexible construction so that it follows the movement of the spring contact 22, even if the magnetic switch is actuated frequently, without tearing off as a result of material fatigue. Arranged on the underside of the pin 14 is a rocker 20, the functioning of which is clear from FIG. 3.

Figure 3:
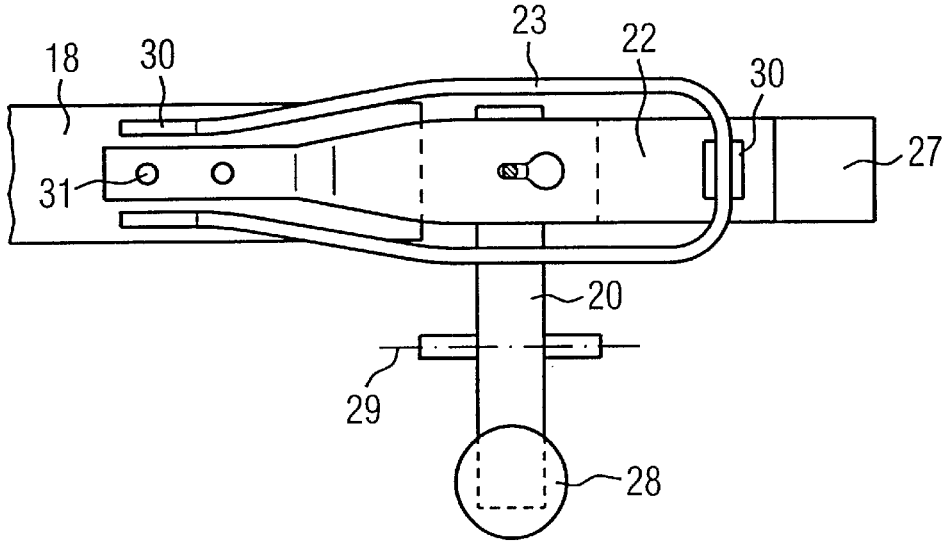
FIG. 3 shows the contact assembly of the magnetic switch from FIG. 2, in plan view.

FIG. 3 shows the second fixed contact 18, to which the spring contact 22 is secured. With the aid of the spring contact 22, the second fixed contact 18 may be connected to the first fixed contact (not illustrated in FIG. 3), which is secured to the contact beam 27. Arranged on the underside of the spring contact 22 is a movable contact (not illustrated in FIG. 3). This movable contact is connected by means of solder 30 to a litz wire 23, which for its part is secured by means of solder 30 to the second fixed contact 18. The spring contact 22 is connected to the second fixed contact 18 by riveting 31. Arranged below the spring contact 22 is a rocker 20 pivotal about a rocker axis 29. Arranged on the side of the rocker 20 opposite the spring contact 22 is for example a pressure spring 28 which keeps the armature in the opened condition.

Figure 4:
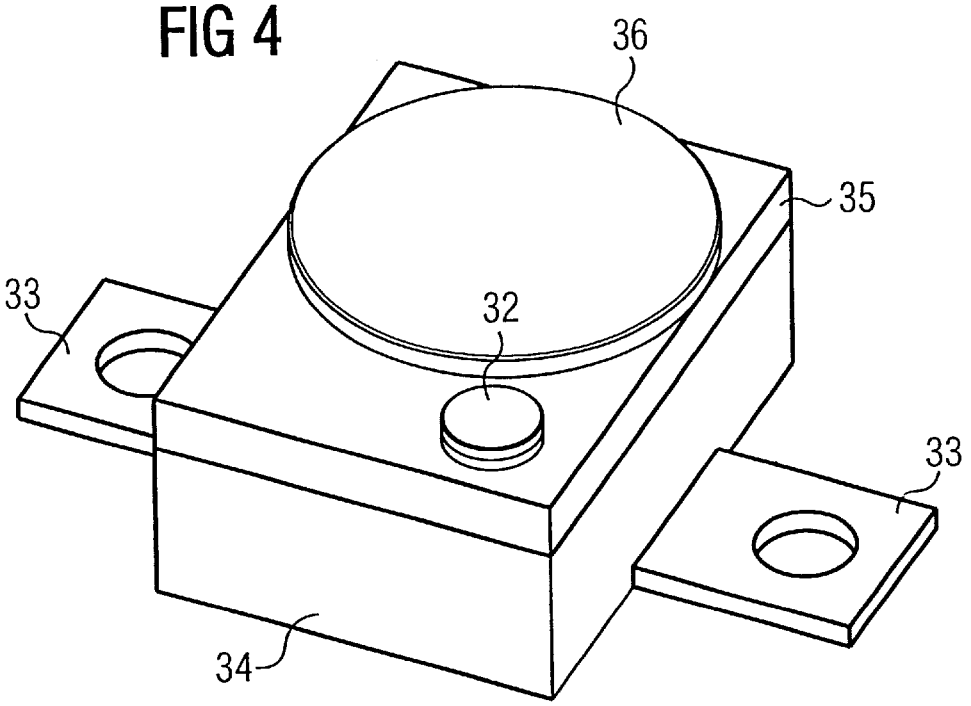
FIG. 4 shows a magnetic switch installed in a housing.

FIG. 4 shows the magnetic switch according to the invention, installed in a housing 34 having a cover 35. By means of a diaphragm 36 arranged above the armature 11, the magnetic switch may be closed manually. Laterally with respect to the magnetic switch, load terminals 33 are guided into the housing 34. These load terminals 33 may for example be encased inside the housing 34 by injection moulding. Instead of the pressure spring 28 shown in FIG. 3, it is also possible for an actuating element 32 which is guided upwards out of the housing 34 to be secured to the rocker. With the aid of the actuating element 32, the magnetic switch may be opened manually.

Figure 5:
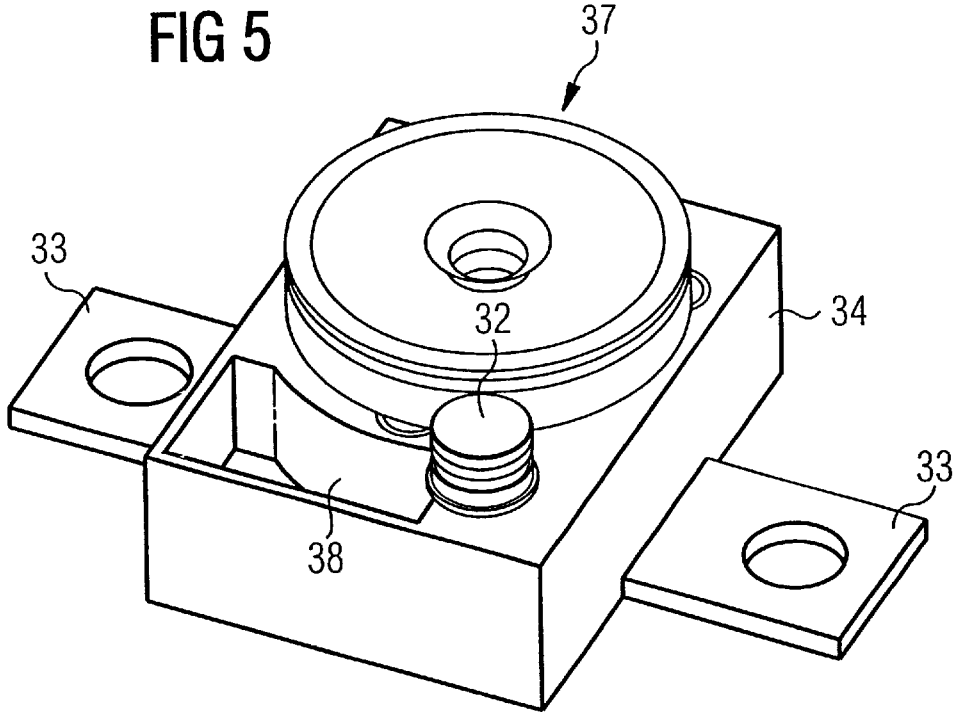
FIG. 5 shows the magnetic switch illustrated in FIG. 4, without the cover.

FIG. 5 shows the housing 34 in the opened condition. Next to the magnet system 37 of the magnetic switch and the actuating element 32 there is provided in the housing 34 a chamber 38 in which for example switching electronics for the magnetic switch may be accommodated. Laterally with respect to the magnetic switch, load terminals 33 are guided into the housing 34.

Figure 6:
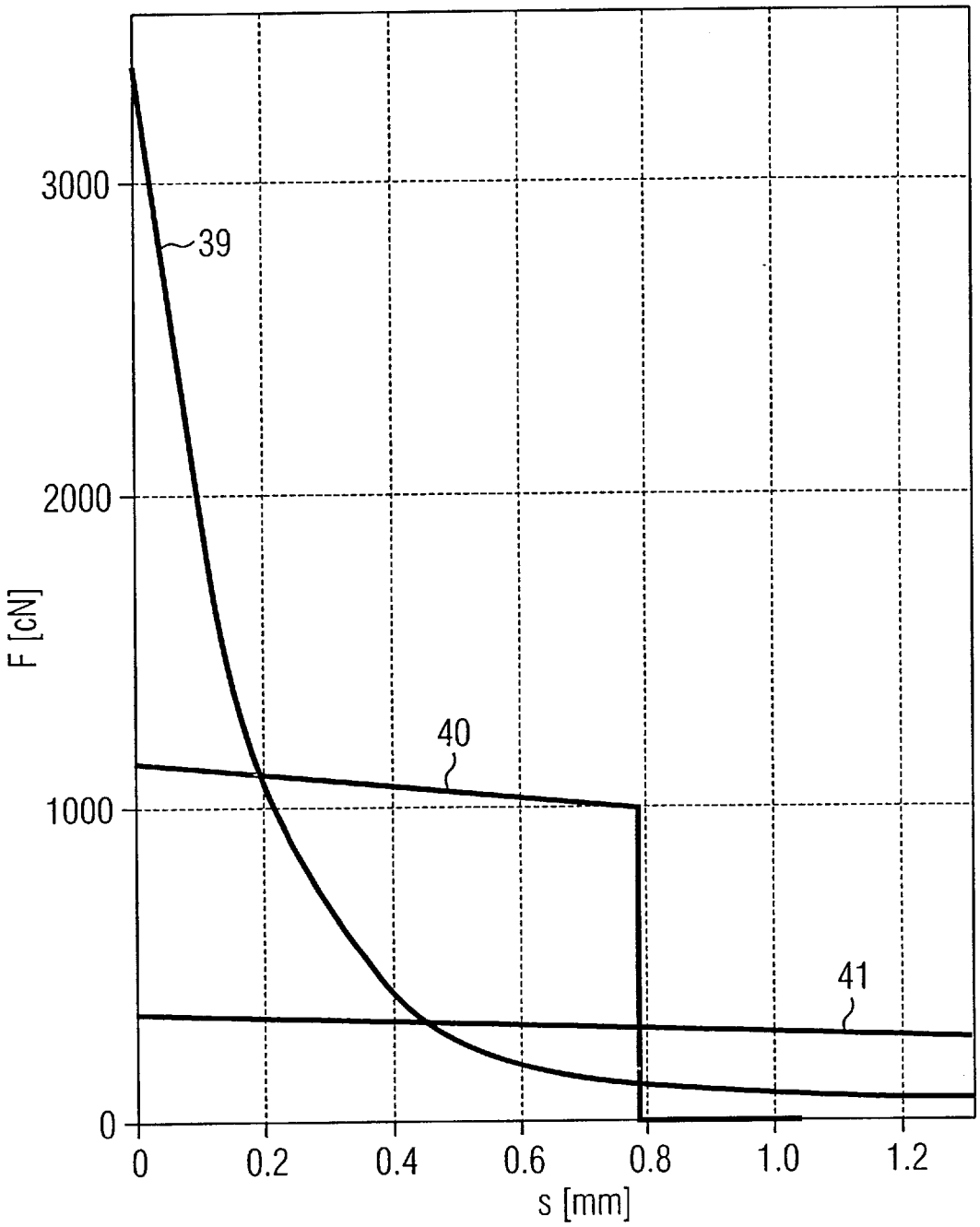
FIG. 6 shows the armature holding force, the contact force acting on the fixed contacts, and the spring force of the pressure spring on the rocker, as a function of the spacing between the armature and the cup, illustrated in a measurement graph.

FIG. 6 shows the armature holding force 39, the contact force 40 acting on the fixed contacts, and the spring force of the pressure spring 41 on the rocker as a function of the spacing s between the armature and the cup, illustrated in a measurement graph for the embodiment of the magnetic switch illustrated in FIG. 1, in the closed condition. When s=0, the armature holding force 39 is approximately 35 N. The armature holding force decreases sharply as the spacing s between the armature and the cup increases, as a result of the weakening of the magnetic field as the operational air gap grows larger. Similarly, the contact force 40 decreases as the spacing s between the armature and the cup increases, although only linearly, in accordance with the force/distance curve of a spring. Similarly, the spring force of the pressure spring 41 decreases linearly with increasing spacing s between the armature and the cup, in accordance with the force/distance curve of a spring. From a spacing s between the armature and the cup of approximately 0.8 mm, the contact is opened, as a result of which the contact force 40 goes down to zero. At this spacing, the armature holding force 39 is still only very small, being still approximately 1 N, as a result of which the armature is held in the opened position by the spring force 41 of the pressure spring.

The invention is not restricted to the embodiments indicated by way of example, but is defined in its most general form by claim 1.

I claim:

1. A magnetic switch comprising a yoke which has the shape of a cup with an axis of symmetry and with a base and a wall, containing therein a core having a radial core flange at an end facing the base, this radial core flange defining with the wall a marginal air gap with a width of $H_R$ and a magnetic resistance of $W_R$, a plate-shaped permanent magnet which is magnetised parallel to the axis of symmetry and is arranged between the core flange and the base and is magnetically coupled thereto, a coil whereof the coil axis corresponds to the axis of symmetry;

which is covered by a plate-shaped armature which forms with the yoke a yoke air gap with a width of $H_J$ and defines with the core a core air gap with a width of $H_K$, which together form an operational air gap, which has a magnetic resistance of $W_A$, having a member for lifting the armature axially away from the cup, in which, in the closed condition, the following applies: $W_A<W_R$.

2. A switch according to claim 1, wherein $10<W_R/W_A<100$.

3. A switch according to claim 1, wherein the yoke, permanent magnet, core, coil and armature are arranged rotationally symmetrically about the axis of symmetry.

4. A switch according to claim 1, wherein the permanent magnet is of a material containing barium ferrite.

5. A switch according to claim 1, wherein the yoke and/or the core are of a material which contains magnetically soft iron.

6. A switch according to claim 1, wherein the core and the yoke are dimensioned, at least in the region of the corresponding air gaps in cross-section such that in the closed condition and in the absence of excitation there is almost magnetic saturation.

7. A switch according to claim 6, wherein the plate thickness of the armature varies radially.

8. A switch according to claim 1, wherein a hole running along the axis of symmetry is provided in the yoke, the permanent magnet, the core and the armature, and through this hole runs a pin which is secured to the armature at one end, and at the other end is coupled to a movable contact which makes contact with a first fixed contact in the closed condition.

9. A switch according to claim 8, wherein the movable contact is a flange-shaped contact disc which is arranged symmetrically with respect to the axis of symmetry and has a central contact disc hole, in which the pin is secured in the hole in the armature by means of flange-shaped end portions and is suspended in the contact disc from a collar projecting into the contact disc hole, in which the contact disc makes contact with a second fixed contact in the closed condition, in which a pressure spring contact supported against the armature and the contact disc is arranged in the hole in the permanent magnet, and in which the end of the pin remote from the armature is pre-tensioned in the direction of the armature via a rocker by means of a tension or pressure spring.

10. A switch according to claim 9, wherein the length of the pin is such that when the magnetic switch opens, the lower pin flange moves by an overtravel distance $H_U$ before engaging the contact disc.

11. A switch according to claim 10, wherein the overtravel distance $H_U$ is 0.5 mm<$H_U$<1 mm.

12. A switch according to claim 9, wherein an actuating element is arranged on the rocker for the purpose of opening the switch manually.

13. A switch according to claim 8, wherein the pin (14) is suspended in a spring contact secured to the second fixed contact and bearing the movable contact.

14. A switch according to claim 13, wherein the movable contact is electrically connected to the second fixed contact by means of a litz wire.

15. A switch according to claim 1, wherein the cup has a radial extent of between 10 mm and 50 mm.

16. A switch according to claim 1, wherein 0.005 mm<$H_J$<0.05 mm, 0.005 mm<$H_K$<0.05 mm, and 1 mm<$H_R$<0.1 mm.

* * * * *